US007552515B2

(12) United States Patent
Funo

(10) Patent No.: US 7,552,515 B2
(45) Date of Patent: Jun. 30, 2009

(54) BELT ADJUSTER

(75) Inventor: Yasuaki Funo, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/490,465

(22) Filed: Jul. 20, 2006

(65) Prior Publication Data

US 2007/0022577 A1 Feb. 1, 2007

(30) Foreign Application Priority Data

Jul. 29, 2005 (JP) ..... 2005-221299

(51) Int. Cl.
*A44B 11/04* (2006.01)

(52) U.S. Cl. ..... 24/200

(58) Field of Classification Search ..... 24/197, 24/198, 169, 200; D11/216, 218
See application file for complete search history.

(56) References Cited

U.S. PATENT DOCUMENTS 4,637,099 A * 1/1987 Kasai ..... 24/200
D340,008 S * 10/1993 Anscher ..... D11/218
D467,838 S * 12/2002 Yoshiguchi ..... D11/218
D496,605 S * 9/2004 Anscher et al. ..... D11/218
D509,769 S * 9/2005 Krauss ..... D11/218
7,020,939 B2 * 4/2006 Anscher ..... 24/625
7,024,734 B2 * 4/2006 Anscher ..... 24/625
2005/0086772 A1 * 4/2005 Yoshiguchi ..... 24/197

FOREIGN PATENT DOCUMENTS

JP 64-6098 2/1989

* cited by examiner

*Primary Examiner*—James R Brittain
(74) *Attorney, Agent, or Firm*—Alston & Bird LLP

(57) ABSTRACT

A frame (10) including lateral bars (11, 12) and vertical bars (13); a first belt holding section (20) provided on a lateral bar side of the frame, into which a length adjustable belt is inserted to be held; a second belt holding section (30) having a belt winding bar (31) around which a length adjustable belt (2) is wound and an abutment bar (33) for bending a folded portion of the length adjustable belt; and a finger-placing section (40) provided on the other lateral bar side of the abutment bar are provided. The finger-placing section has a through-hole (41) that is provided with a guide section (a curved surface 12A) for guiding fingers.

3 Claims, 10 Drawing Sheets

BELT ADJUSTER

BACKGROUND OF THE INVENTION

1. Field of the Invention

The present invention relates to a belt adjuster for fastening a first belt and a second belt to each other and for holding the second belt such that a length thereof is adjustable.

2. Description of Related Art

As such a belt adjuster for fastening a fixation belt and a length adjustable belt, a belt adjuster disclosed in the Document (Japanese Laid-open utility model publication No. Sho 64-6098: FIGS. 1, 5, 6 and 7) has long been known.

As shown in FIGS. 10 and 11, the belt adjuster disclosed includes: a frame 104 having a base section 101, a pair of leg sections 102 extending in parallel in a common direction from respective ends of the base section 101, and a connecting section 103 connecting the leg sections 102 on the opposite side of the base section 101; a belt attachment pole 105 integrally provided to bridge the pair of leg section at a position near the connecting section 103 of the frame 104; a belt-folding pole 106 integrally provided to bridge the pair of leg sections 102 at a position near the base section 101 of the frame 104; a belt-receiving section 107 provided so as to form a right angle extending from a front side toward a rear side at a position on the belt-folding pole 106 side of the base section 101; and a holding section 108 provided so as to project in a trapezoidal shape toward the opposite side of that of the belt-folding pole 106 of the base section 101.

When in use, the fixation belt 100A is threaded between the belt attachment pole 105 and the belt-folding pole 106 from the rear side to the front side, and then threaded between the belt attachment pole 105 and the connecting section 103 from the front side to the rear side to be fixed by a rivet or by suturing. On the other hand, the length adjustable belt 100B is threaded between the belt attachment pole 105 and the belt-folding pole 106 from the rear side to the front side, and then threaded between the belt-folding pole 106 and the belt-receiving section 107 from the front side to the rear side.

In order to adjust the length of the length adjustable belt 100B from this state, the whole belt adjuster is rotated in a direction away from the holding section 108 (in anticlockwise direction in FIG. 11) around a rotation axis on the connecting section 103 side by raising the holding section 108 with fingers. Accordingly, the belt-receiving section 107 becomes separated from the length adjustable belt 100B, increasing a bending angle of the length adjustable belt 100B. In this state, the length adjustable belt 100B can be adjusted to have a desired length by pulling a tip end side thereof.

According to the arrangement disclosed in the Document, the width of the holding section 108 is approximately less than half of that of the base section 101, so that it is difficult to hold the holding section 108 with fingers.

The holding section 108 is formed with a hole 109 passing through from the upper surface side to the rear side. However, since the shape of the hole 109 is trapezoidal, which is similar to that of the holding section 108, the hole 109 does not have a function for guiding fingers thereon to its center. Hence, in a case in which a user holds the holding section 108 at a position off the center with fingers to rotate the whole belt adjuster, the belt adjuster will be rotated in a slanted posture, which may prevent smooth length adjustment of the length adjustable belt 100B.

When the user holds the holding section 108 with fingers and rotates it, since a rear surface of the holding section 108 is flat, the holding section 108 is slippery, so that the belt adjuster may be rotated aslant by raising the rear surface of the holding section 108. Also in this case, the length of the length adjustable belt 100B may not be smoothly adjusted like in the case described above.

SUMMARY OF THE INVENTION

An object of the present invention is to provide a belt adjuster that can offer an easy and accurate length adjustment of a belt.

A belt adjuster of an aspect of the present invention fastens a first belt and a second belt to each other, the second belt being held in a length-adjustable manner. The belt adjuster includes: a frame including two lateral bars and two vertical bars, the lateral bars including a first lateral bar and a second lateral bar; a first belt holding section provided adjacent to the first lateral bar of the frame, into which the first belt is inserted to be held; a second belt holding section having: a belt winding bar provided between the two vertical bars of the frame, around which the second belt is wound to be turned back to a rear side of the frame, and an abutment bar provided between the two vertical bars in the vicinity of the belt winding bar, the abutment bar abutting at a folded portion of the second belt to bend the second belt; and a finger-placing section provided adjacent to the second lateral bar of the frame relative to the abutment bar. The finger-placing section is provided with a through-hole passing from a front side to the rear side of the frame and a guide section for guiding a finger to the through-hole.

According to this aspect of the invention, the first belt is inserted in the first belt holding section to be held, while the second belt is wound around the belt winding bar to be turned back to the rear side of the frame and a tip end of the folded side is drawn to lie in the direction in which the length adjustable belt 2 extends. The abutment bar abuts the folded portion to bend the second belt, generating a large resistance on the second belt against the pulling direction. Accordingly, even when a tensile force is applied in the longitudinal direction of the first belt and the second belt, the second belt will not be slack.

When adjusting the length of the second belt, the user holds the finger-placing section with fingers (usually with his thumb and index finger) and rotates the frame toward the front side with the lateral bar side of the frame as a supporting point. Hence, the bending angle of the second belt bent by the abutment bar increases to reduce the resistance against the pulling force. In this state, the length of the second belt can be adjusted to a desired length by pulling the second belt.

In the length adjustment, when the user holds the finger-placing section with his thumb and index finger, the cushions of the two fingers are positioned in the through-hole, making it easy to hold. Further, since the through-hole has the guide section for guiding the fingers, the fingers can be appropriately positioned. Thus, when the frame is rotated with the lateral bar as a supporting point, the frame can be prevented from being rotated aslant. Thereby, the belt length adjustment can be easy and accurate.

According to a belt adjuster of another aspect of the invention, the guide section may preferably be provided on a rear side of the finger-placing section.

According to this aspect of the invention, when the finger-placing section is held with the thumb and index finger and the frame is rotated with the lateral bar as a supporting point in a length adjustment of the second belt, the finger inserted in the rear side of the frame is placed at an appropriate position of the through-hole by the guide section, thereby preventing the frame from being rotated aslant. In addition, the rotation can be made with a small force.

When the frame is rotated by holding the finger-placing section with the thumb and index finger, the finger inserted in the rear side of the frame usually plays a roll of raising the frame. In contrast, with the invention, the finger inserted in the rear side of the frame is placed at an appropriate position of the through-hole, thereby preventing the frame from being rotated aslant and enabling the frame to be rotated with a small force.

A belt adjuster of another aspect of the invention, the second lateral bar of the frame may preferably include a curved surface curving toward the front side of the frame from both ends to the center of a rear side of the second lateral bar. The curved surface constitutes a part of the guide section.

According to this aspect of the invention, the through-hole is provided between the abutment bar and the lateral bar substantially at the longitudinal center of these bars, while the lateral bar has the curved surface curving toward the front side of the frame from both the ends to the center of the rear surface and the curved surface constitutes a part of the guide section. Hence, when holding the finger-placing section with the thumb and index finger, the finger inserted in the rear side of the frame is guided by the curved surface to be positioned at the center of the frame, thereby enabling the frame to be rotated without being slanted.

A belt adjuster of another aspect of the invention, the through-hole may preferably have a shape in which a size in the vertical bars direction of the frame increases from the both ends to the center of the vertical bars.

According to this aspect of the invention, the through-hole is formed in the shape in which the size of the frame in the vertical bars direction increases from both the ends. Hence, even when the user holds with fingers at a displaced position of the through-hole, the user can recognize that he is holding at the displaced position of the through-hole owing to the feeling of the fingers. Thereby, the user can be prevented from holding at a displaced position of the through-hole and rotating the frame aslant.

A belt adjuster of another aspect of the invention, the second lateral bar and the abutment bar may preferably enclose the through-hole to form a substantially triangular shape.

In the state in which the second belt is wound around the belt winding bar of the second belt holding section, turned back to the rear side and abutted by the abutment bar such that the tip end of the folded side is drawn to lie along the direction in which the length adjustable belt extends, a tensile force applied in the longitudinal direction of the first belt or the second belt generates a large load on the abutment bar.

According to the aspect of the invention, the lateral bar and the abutment bar enclose the through-hole, forming the substantially triangle shape, that is, a truss structure, thereby providing a strong structure with little deformation.

A belt adjuster of another aspect of the invention, a front surface of the abutment bar may preferably be located adjacent to the rear side of the frame relative to front sides of the belt winding bar and the second lateral bar.

According to this aspect of the invention, when holding the finger-placing section with the thumb and index finger, the user places one of the fingers on the front side of the frame at a position between the belt winding bar and the lateral bar such that the cushion of the finger abuts on the front surface of the abutment bar and in the through-hole. Hence, the finger is guided to an appropriate position to avoid a displacement of the finger during rotation.

A belt adjuster of another aspect of the invention, a surface of the abutment bar may preferably face to the lateral bar of the frame and include a slant surface that inclines toward the first lateral bar as extending from the front side to the rear side of the frame. The slant surface constitutes a part of the guide section.

According to this aspect of the invention, when holding the finger-placing section with the thumb and index finger, the end of the finger inserted in the rear side of the frame can be deeply inserted owing to the slant surface of the abutment bar. Thereby, the finger-placing section can be securely held with the thumb and index finger.

DETAILED DESCRIPTION OF PREFERRED EMBODIMENT(S)

An embodiment according to the present invention will be described below with reference to the attached drawings.

Figure 1:
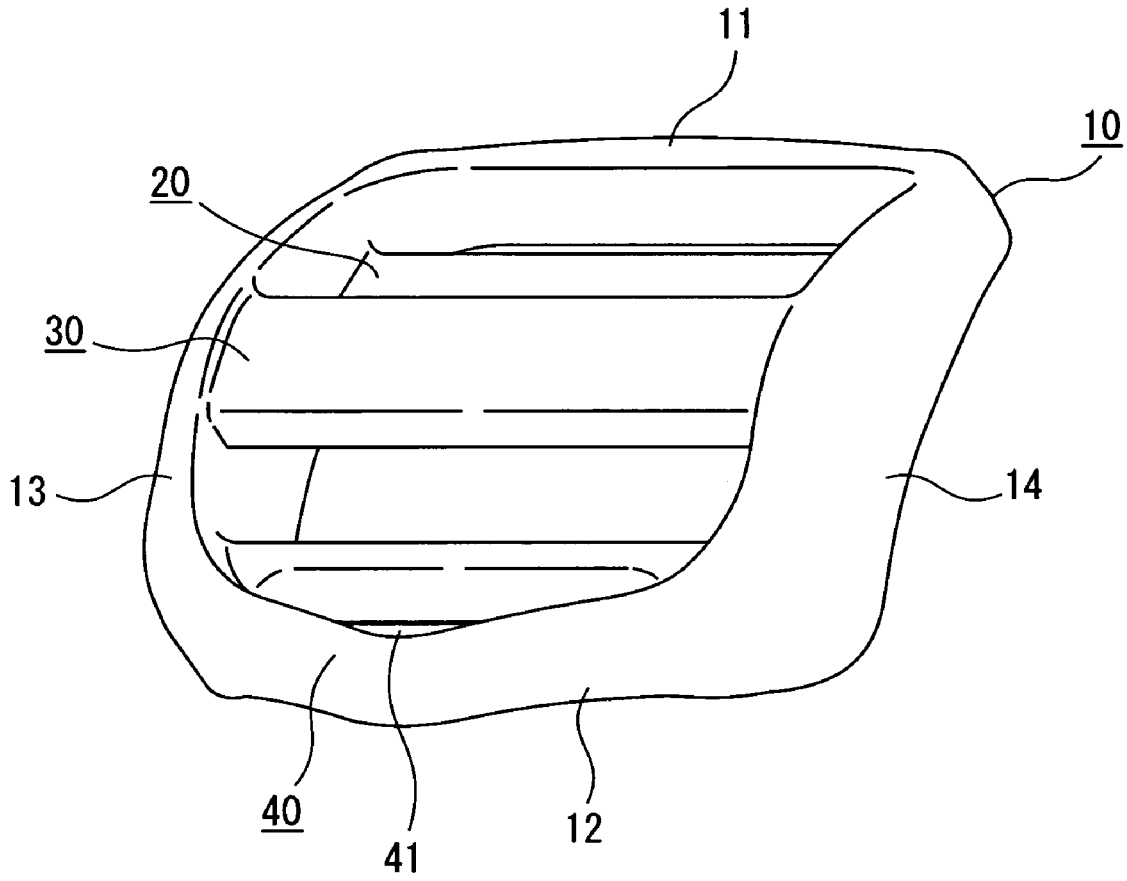
FIG. 1 is a perspective view of a belt adjuster of an embodiment.
Figure 2:
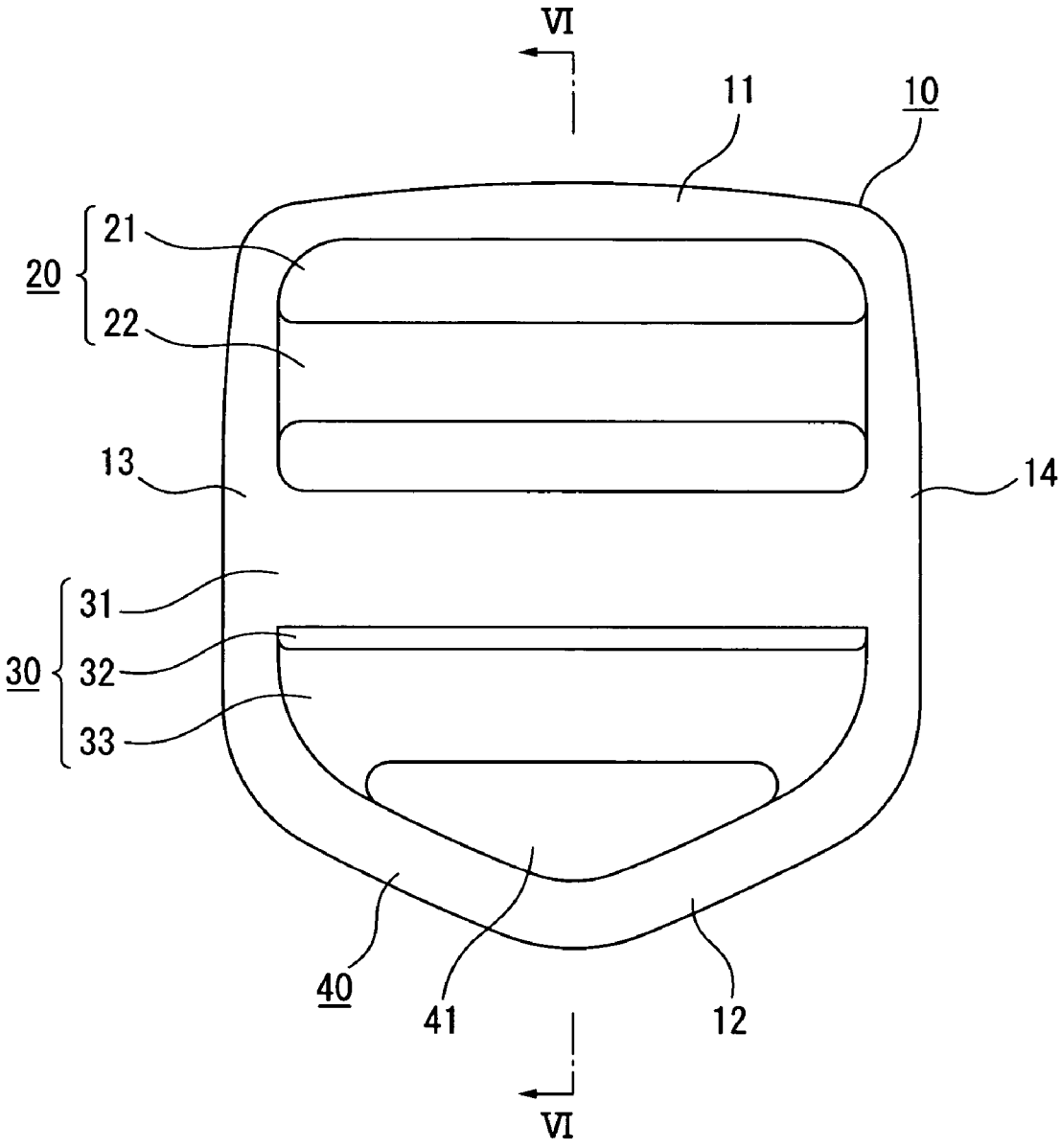
FIG. 2 is a front view of the belt adjuster of the embodiment.
Figure 3:
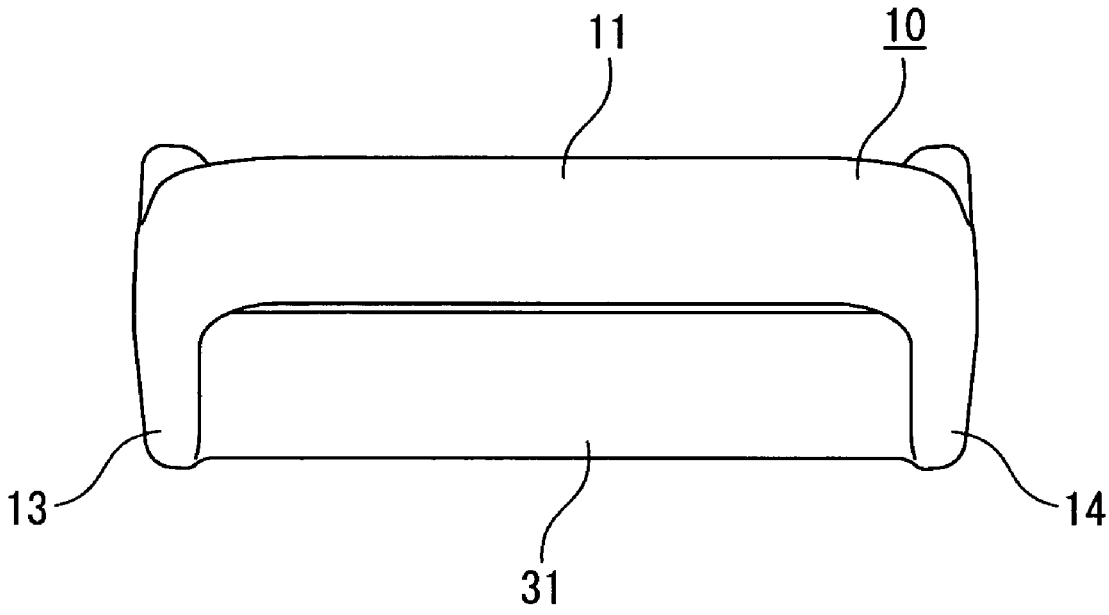
FIG. 3 is a plan view of the belt adjuster of the embodiment.
Figure 4:
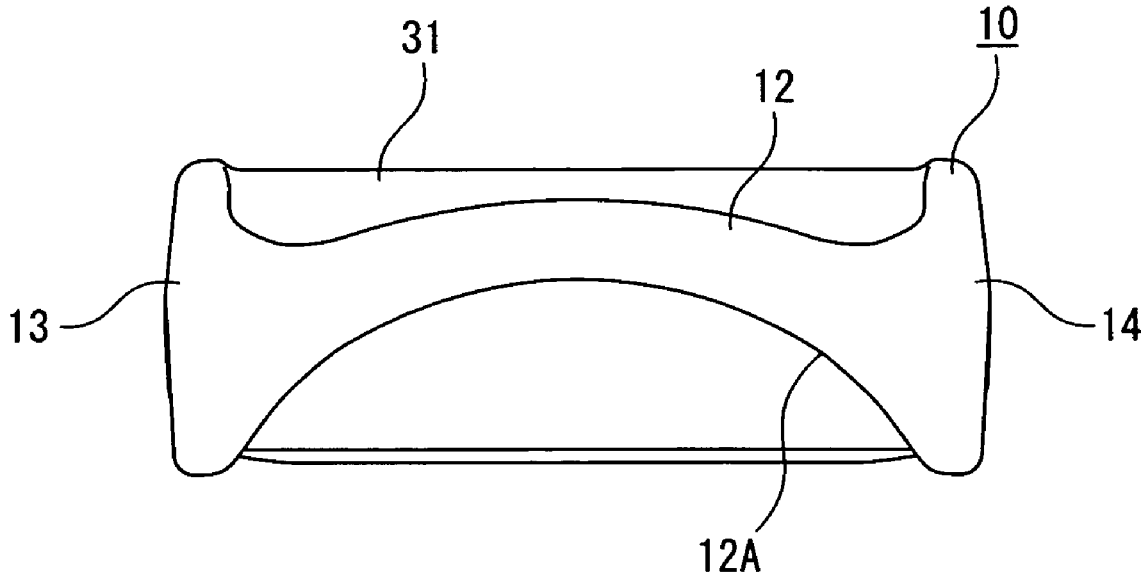
FIG. 4 is a bottom view of the belt adjuster of the embodiment.
Figure 5:
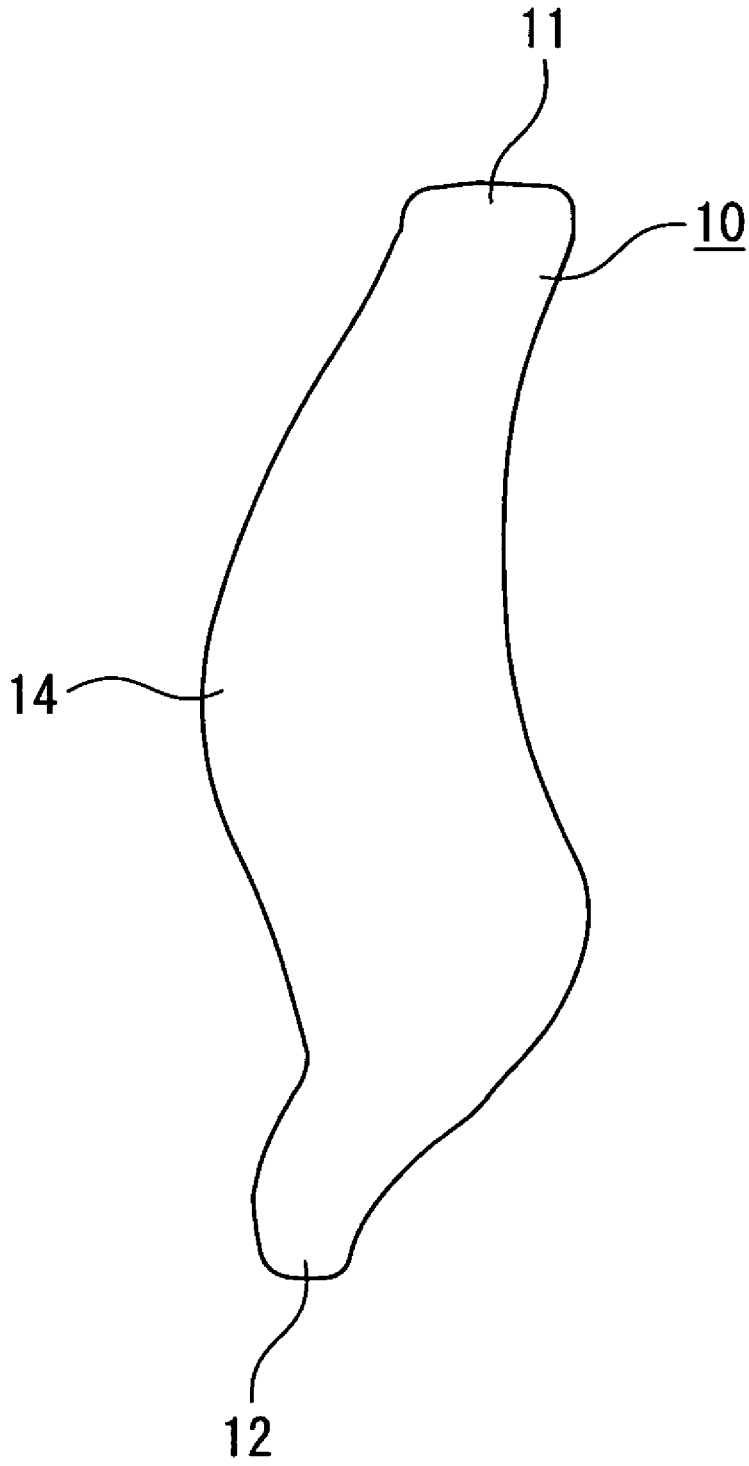
FIG. 5 is a side view of the belt adjuster of the embodiment.
Figure 6:
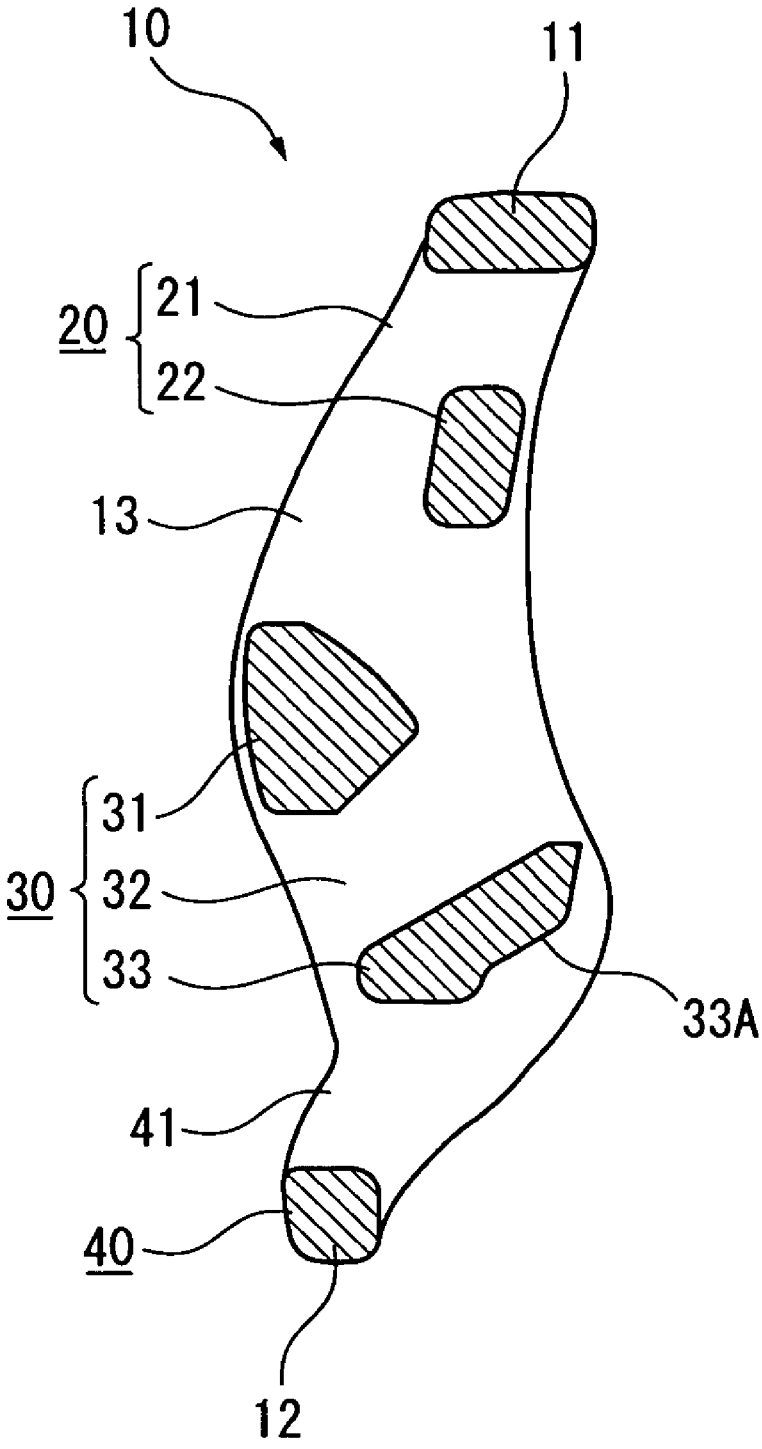
FIG. 6 is a cross section taken along line VI-VI in FIG. 2.
Figure 7:
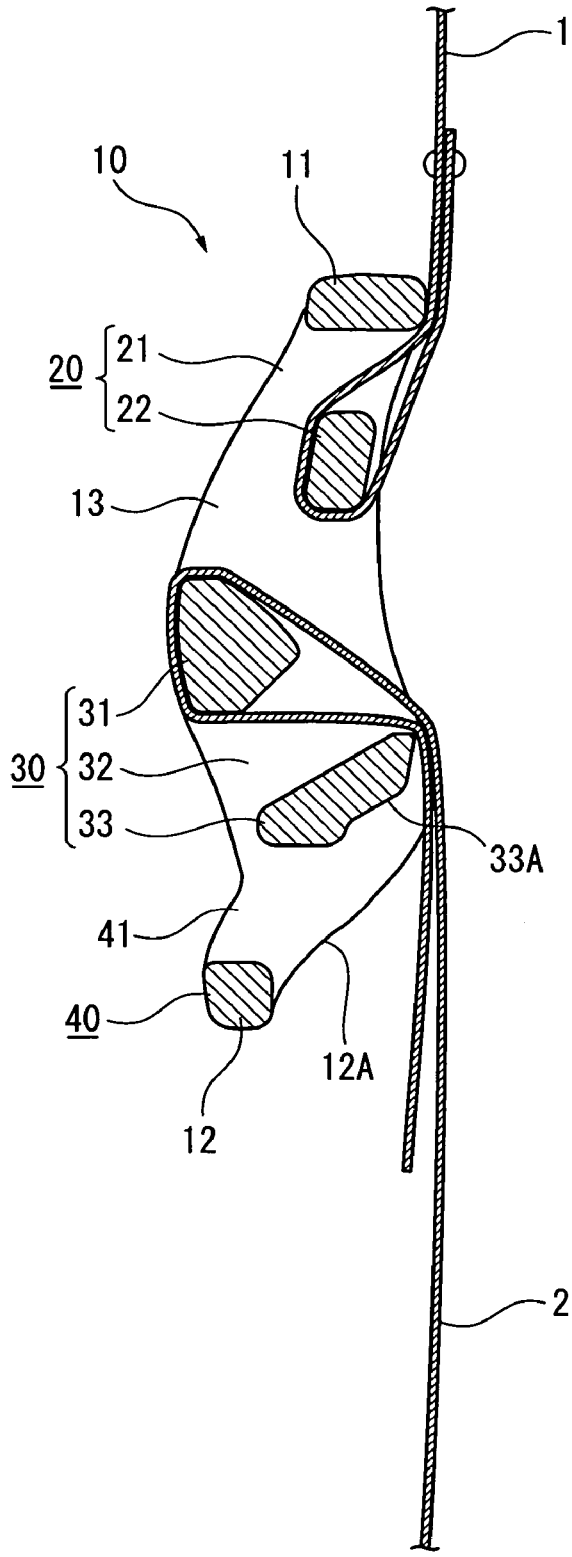
FIG. 7 is the cross section of FIG. 6 with belts attached.
Figure 8:
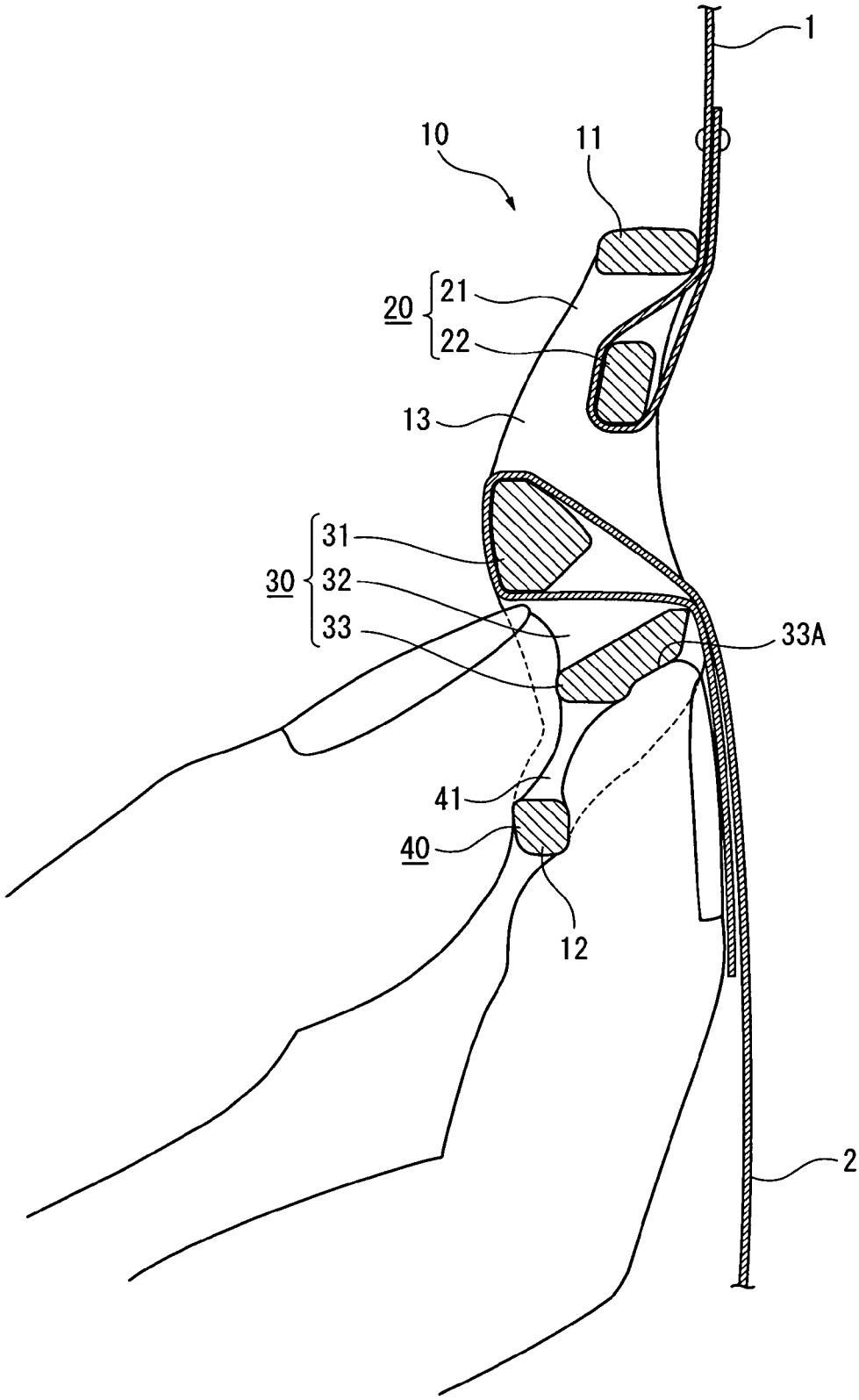
FIG. 8 is a view showing a state just before adjusting a length of the belt.
Figure 9:
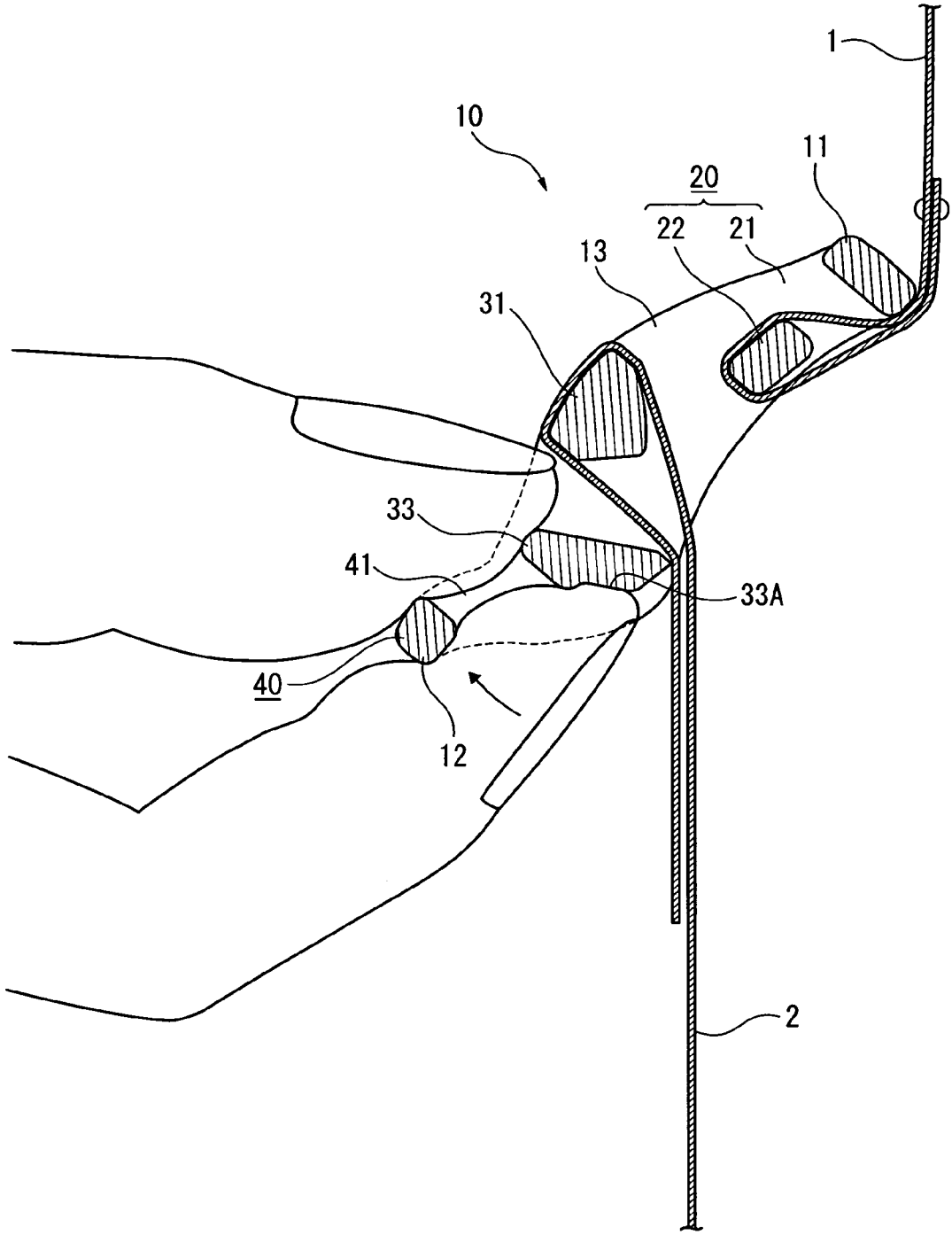
FIG. 9 is a cross section showing a state in which the belt adjuster is rotated for a length adjustment of the belt.
Figure 10:
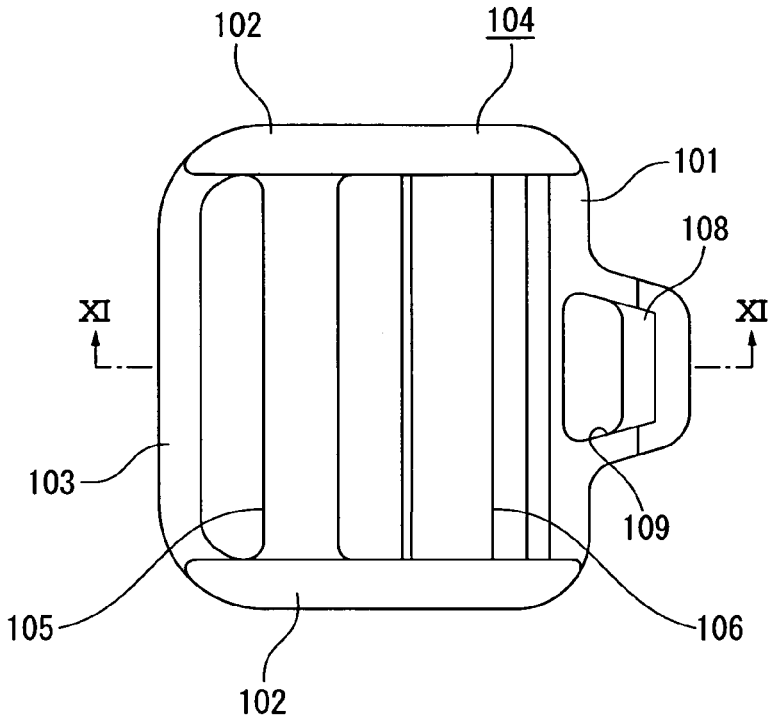
FIG. 10 PRIOR ART
FIG. 10 is a plan view of a belt adjuster of the prior art.
Figure 11:
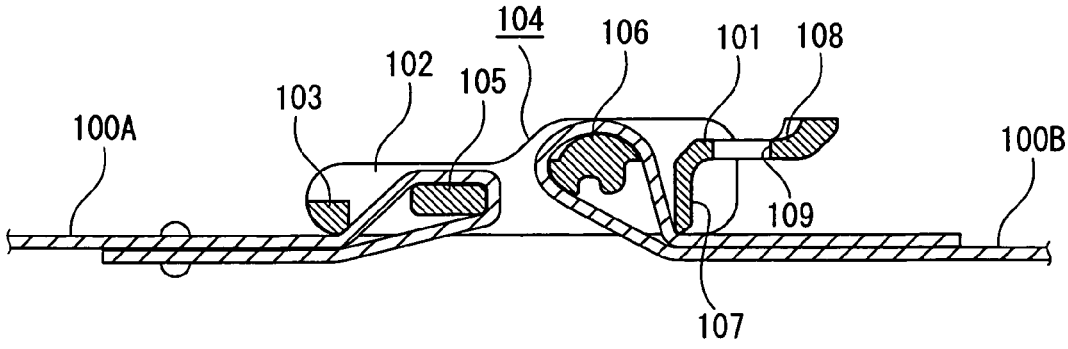
FIG. 11 PRIOR ART
FIG. 11 is a cross section taken along line XI-XI in FIG. 10.

FIG. 1 is a perspective view of a belt adjuster of the embodiment. FIG. 2 is a front view of the belt adjuster. FIG. 3 is a plan view of the belt adjuster. FIG. 4 is a bottom view of the belt adjuster. FIG. 5 is a side view of the belt adjuster. FIG. 6 is a cross section taken along line VI-VI in FIG. 2. FIG. 7 is the cross section of FIG. 6 with belts attached. FIG. 8 is a view showing a state just before adjusting a length of the belt. FIG. 9 is a cross section showing a state in which the belt adjuster is rotated for a length adjustment of the belt.

[Arrangements]

As shown in FIG. 1 and FIGS. 7 to 9, the belt adjuster of the embodiment fastens a fixation belt 1 as a first belt and a length adjustable belt 2 as a second belt to each other and holds the length adjustable belt 2 such that a length thereof is adjustable. The belt adjuster includes a frame 10 having a vertically long and substantially polygon shape formed by synthetic resin injection molding.

As shown in FIGS. 1 to 6, the frame 10 includes two lateral bars 11, 12 (a first lateral bar 11, a second lateral bar 12) and two vertical bars 13, 14 (a first vertical bar 13, a second vertical bar 14) to form a vertically long and substantially pentagonal shape as a whole, the vertical bars 13, 14 integrally connecting respective ends of the two lateral bars 11, 12.

Among the lateral bars 11, 12, the lateral bar 11 has a width being uniform along a length direction thereof and a thickness gradually increasing from both the ends (see, respectively, FIGS. 3 and 2). While, the lateral bar 12 is formed to have oblique lines inclined outwardly toward the outside of the frame 10 from both the ends to the center, when seen from the front side. The lateral bar 12 has a shape curving outwardly toward the front side of the frame 10 from both the ends to the center, when seen from the bottom side (see FIGS. 2 and 4). The front and rear side surfaces of the lateral bar 12 are curved so as to project outwardly toward the front side of the frame 10 from both the ends to the center, forming a curved surface 12A. Thus, the curved surface 12A formed on the rear side of the lateral bar 12 constitutes a guide section.

The vertical bars 13, 14 are formed to have a dogleg shape in which the bars 13, 14 are outwardly inclined as extending from the lateral bar 11 toward the lateral bar 12 and then reversely inclined toward the rear side of the frame 10. The width of the vertical bars 13, 14 increases as extending from the lateral bar 11 to the center thereof and remains the same from the center to the lateral bar 12.

The frame 10 includes a first belt holding section 20 for holding the fixation belt 1 (the first belt) on the lateral bar 11 side; a second belt holding section 30 for holding the length adjustable belt 2 (the second belt) in the length adjustable manner at a center portion of the two vertical bars 13, 14; and a finger-placing section 40 on the lateral bar 12 side.

The first belt holding section 20 is formed so as to include a belt holding bar 22 integrally provided at a position near the lateral bar 11 with a belt insertion hole 21 interposed between the belt holding bar 22 and the lateral bar 11. The belt holding bar 22 has a rectangular shape in cross section.

The second belt holding section 30, which is disposed between the first belt holding section 20 and the finger-placing section 40, is formed so as to include a belt winding bar 31 provided substantially at the center of the two vertical bars 13, 14 of the frame 10, around which the length adjustable belt 2 is wound to be turned back to the rear side of the frame 10 and an abutment bar 33 integrally provided between the two vertical bar 13, 14 in the vicinity of the belt winding bar 31 via a belt insertion hole 32 for abutting a turning point of the length adjustable belt 2

The belt winding bar 31 has a front surface arcing along the front surface lines of the two vertical bars 13, 14 and a pentagonal shape in cross section with a triangular projection on the rear side. At least a portion that holds (abuts to) the length adjustable belt 2 of the abutment bar 33 has a front surface positioned on the rear side of the front surfaces of the belt winding bar 31 and the lateral bar 12. A surface facing the lateral bar 12 of the frame 10 is formed to be a slant surface 33A inclined toward the lateral bar 11 side as extending from the front side to the rear side of the frame 10. The guide section also includes this slant surface.

The finger-placing section 40 is formed on the lateral bar 12 side of the abutment bar 33. In this particular embodiment, the finger-placing section 40 includes the abutment bar 33 and the lateral bar 12. The finger-placing section 40 has a through-hole passing through the frame 10 from the front side to the rear side substantially at the longitudinal center of the abutment bar 33 and the lateral bar 12 therebetween.

The through-hole 41 has a shape in which a size in the vertical bars 13, 14 direction of the frame 10 increases from both the ends on the lateral bar 12 side to the center of the vertical bars 13, 14. The through-hole 41 has a triangular shape in this embodiment. Accordingly, the abutment bar 33 and the lateral bar 12, which are enclosing the through-hole 41, are also forming a substantially triangular shape.

[How to Use]

Initially, the fixation belt 1 is inserted through the first belt holding section to be held. Specifically, as shown in FIG. 7, the fixation belt 1 is threaded through the belt insertion hole 21 between the lateral bar 11 and the belt holding bar 22 from the rear side to the front side, subsequently wound around the belt holding bar 22 to be brought to the rear side, and then fixed by a rivet or by suturing.

The length adjustable belt 2 is wound around the belt winding bar 31 of the second belt holding section 30 and drawn back to the rear side of the frame 10, and a tip end of the folded side is then drawn to lie in the direction in which the length adjustable belt 2 extends. In other words, as shown in FIG. 7, the length adjustable belt 2 is threaded through the belt holding bar 22 and the belt winding bar 31 to be drawn to the front side from the rear side, wound around the belt winding bar 31 to be drawn through the belt insertion hole 32 defined between the belt winding bar 31 and the abutment bar 33 to the rear side, and abutted by the abutment bar 33 to be drawn back to lie along the length adjustable belt 2.

In this state, the length adjustable belt 2 is bent substantially at a right angle at two corners on the front side of the belt winding bar 31 and is further bent at one corner on the rear side of the abutment bar 33, generating a large resistance against the pulling direction. Hence, even when a tensile force is applied in the longitudinal direction of the fixation belt 1 and the length adjustable belt 2, the length adjustable belt 2 will not be slack.

When adjusting the length of the length adjustable belt 2, the user holds the finger-placing section 40 with fingers (usually with his thumb and index finger) and rotates the frame 10 toward the front side with the lateral bar 11 side of the frame 10 as a supporting point.

When the user hold the finger-placing section 40 with his thumb and index finger in this operation as shown in FIG. 8, for example, by holding with the thumb on the front surface of the finger-placing section 40 and the index finger on the rear surface of the finger-placing section 40, the thumb is placed between the belt winding bar 31 and the lateral bar 12, and its finger cushion (of the thumb) abuts the abutment bar 33 and the through-hole 41 on the front side.

At this time, even when the user places his thumb on an inappropriate position of the through-hole 41, the user can recognize that he is holding at an inappropriate position of the through-hole 41 owing to the feeling on the thumb, because the through-hole 41 has a triangle shape in which the size in the vertical bars 13, 14 direction increases toward the center of the through-hole 41. That is, since the shape of the through-hole 41 serves as the guide section for guiding the finger to the center thereof, the user can be prevented from holding such a displaced position of the through-hole 41 and rotating the frame 10 aslant.

On the rear side of the finger-placing section 40, the index finger of the user abuts the rear surface of the lateral bar 12 of the frame 10. In this state, since the rear surface of the lateral bar 12 is the curved surface 12A curving toward the front side of the frame 10 from both the ends to the center, the index finger is guided by the curved surface 12A to the center of the frame 10, that is, to the center of the through-hole 41. Additionally, since the surface of the abutment bar 33, which faces to the lateral bar 12, is the slant surface 33A inclining toward the lateral bar 11 side as extending from the front side to the rear side of the frame 10, the index finger can be inserted deeply due to the slant surface 33A of the abutment bar 33.

As described above, when the user thus holds the finger-placing section 40 with his thumb and index finger and rotates the frame 10 toward the front side of the frame 10 with the lateral bar 11 side as the supporting point, that is, when rotating in the direction of the arrow shown in FIG. 9 (in clockwise direction) to increase the bending angle of the length adjustable belt 2 that has been bent at a substantially right angle (to be an obtuse angle). In other words, the rotation reduces the pulling force, so that the length of the length adjustable belt 2 can be adjusted to a desired length by pulling the length adjustable belt 2 in this state.

[Advantages of Embodiment]

(1) The finger-placing section 40 is provided with the through-hole 41. Accordingly, when holding the finger-placing section 40 with the thumb and index finger, the finger cushions of these two fingers are positioned in the through-hole 41. Hence, it is easy to hold.

(2) The guide section for guiding the fingers in the through-hole 41 is provided on the rear side of the frame 10, preventing the frame 10 from being rotated aslant. Hence, the rotation can be made with a small force. When the frame 10 is rotated by holding the finger-placing section 40 with the thumb and index finger, the finger inserted in the rear side of the frame 10 usually plays a roll of raising the frame 10. In the embodiment, the finger inserted in the rear side of the frame 10 is placed at an appropriate position of the through-hole 41, thereby preventing the frame 10 from being rotated aslant and enabling the frame 10 to be rotated with a small force.

(3) The lateral bar 12 of the frame 10 of the guide section has the curved surface 12A curving toward the front side of the frame 10 from both the ends to the center. Hence, when holding the finger-placing section 40 with the thumb and index finger, the finger inserted in the rear side of the frame 10 is guided by the curved surface 12A to be positioned at the center of the frame 10, that is, at the center of the through-hole 41, thereby enabling the frame 10 to be rotated without being slanted.

(4) The through-hole 41 is formed in the shape in which the size of the frame 10 in the vertical bars 13, 14 direction increases from both the ends to the center. Hence, even when the user holds with fingers at a displaced position of the through-hole 41, the user can recognize that he is holding at the displaced position of the through-hole 41 owing to the feeling of the fingers. Accordingly, the user can be prevented from holding at the displaced position of the through-hole 41 and rotating the frame 10 aslant.

(5) The lateral bar 12 and the abutment bar 33 enclose the through-hole 41, forming the substantially triangle shape, that is, a truss structure, thereby providing a strong structure with little deformation.

In the state in which the length adjustable belt 2 is wound around the belt winding bar 31 of the second belt holding section 30, turned back to the rear side and abutted by the abutment bar 33 such that the tip end of the folded side is drawn to lie in the direction in which the length adjustable belt 2 extends, a tensile force applied in the longitudinal direction of the fixation belt 1 or the length adjustable belt 2 generates a large load on the abutment bar 33. However, the present invention provides a strong structure to avoid deformation or damage.

(6) When holding the finger-placing section 40 with the thumb and index finger, the user places one of the fingers on the front side of the frame 10 at a position between the belt winding bar 31 and the lateral bar 12 such that the cushion of the finger abuts on the front surface of the abutment bar 33 and in the through-hole 41. Hence, the finger is guided to an appropriate position to avoid a displacement of the finger during rotation.

[Modifications]

It is to be noted that the scope of the present invention is not restricted to the above-described embodiment, but includes modifications and improvements as long as an object of the present invention can be achieved.

In the embodiment, the first belt holding section 20 is provided with the belt holding bar 22 integrally bridging the two vertical bars 13, 14 with the belt insertion hole 21 interposed between the lateral bar 11 and the belt holding bar 22, but the invention is not limited to this arrangement. For example, the lateral bar 11 may be a member having a larger thickness, which is provided with a hole in which the fixation belt 1 is inserted to be held.

In the embodiment, the lateral bar 12 of the frame 10 is formed to project to the outside of the frame 10 from both the ends to the center (to make the frame 10 pentagonal as a whole), and the lateral bar 12 and the belt winding bar 31 constitute the finger-placing section 40. However, the finger-placing section 40 may be integrally formed to project from the lateral bar 12 and provided with a guide section for guiding the finger to the through-hole 41.

In the embodiment, the through-hole 41 defined in the finger-placing section 40 is formed to be triangle, but the arrangement is not limited thereto and may have any another shape. For example, the through-hole 41 may be round or rhombus in shape.

The priority application Number JP2005-221299 upon which this patent application is based is hereby incorporated by reference.

What is claimed is:

1. A belt adjuster for fastening a first belt and a second belt adjacent to each other, the second belt being held in a length-adjustable manner, the belt adjuster comprising:

a frame including two lateral bars and two vertical bars, the lateral bars including a first lateral bar and a second lateral bar, and the frame having a front side and a rear side, the rear side being opposite and spaced apart from the front side;

a first belt holding section provided adjacent to the first lateral bar of the frame, into which the first belt is insertable to be held;

a second belt holding section having: a belt winding bar provided between the two vertical bars of the frame, around which the second belt is woundable to be turned back to the rear side of the frame, and at least a rear surface of an abutment bar provided between the two vertical bars in the vicinity of the belt winding bar, the rear surface of the abutment bar adapted to abut a folded portion of the second belt to bend the second belt, the rear surface of the abutment bar being oriented to face substantially the same direction as the rear side of the frame; and a finger-placing section provided adjacent to the second lateral bar of the frame, wherein:

the finger-placing section comprises a through-hole passing from the front side to the rear side of the frame and a guide section for guiding a finger to the through-hole, the guide section is provided on a rear side of the finger-placing section, the rear side of the finger-placing section being oriented to face substantially the same direction as the rear side of the frame, the through-hole is defined by the abutment bar and the second lateral bar of the frame substantially adjacent the longitudinal center of the abutment bar and the second lateral bar, the through-hole forming a substantially triangular shape, the second lateral bar of the frame includes a curved surface on a rear side of the second lateral bar, the curved surface curving toward the front side of the frame from both ends to the center of the rear side of the second lateral bar, the curved surface constituting a part of the guide section, and the rear side of the second lateral bar being oriented to face substantially the same direction as the rear side of the frame, the finger-placing section includes at least a portion of the second lateral bar and at least a portion of the abutment bar, and a front surface of the abutment bar is disposed rearwardly of a plane that extends through a front side of the belt winding bar and a front side of the second lateral bar of the frame such that the front surface of the abutment bar is recessed relative to the front sides of the second lateral bar and the belt winding bar, wherein the front sides of the belt winding bar and the second lateral bar and the front surface of the abutment bar are oriented to face substantially the same direction as the front side of the frame.

2. The belt adjuster according to claim 1, wherein the through-hole has a shape in which a size in the vertical bars direction of the frame increases from the both ends to the center of the vertical bars.

3. The belt adjuster according to claim 1, wherein the abutment bar comprises a slanted surface disposed substantially between the front surface and the rear surface, the slanted surface is slanted relative to a longitudinal axis extending from the first lateral bar in the direction of the second lateral bar, and the slanted surface inclines in a direction toward the first lateral bar as the slanted surface extends from the front side to the rear side of the frame, the slanted surface constituting a part of the guide section.

* * * * *